US006054176A

United States Patent [19]

Kuo et al.

[11] Patent Number: 6,054,176

[45] Date of Patent: Apr. 25, 2000

[54] PROCESS FOR MAKING PU AIR PERMEABLE NUBUCK SHEETS

[75] Inventors: Ping-Hung Kuo, Tainan Hsien; Lung-Chieh Hsieh, Chang-Hua Hsien, both of Taiwan

[73] Assignee: Chifa Leather Corp., Taipei, Taiwan

[21] Appl. No.: 09/327,958

[22] Filed: Jun. 8, 1999

Related U.S. Application Data

[63] Continuation-in-part of application No. 08/898,153, Jul. 22, 1997, abandoned.

[51] Int. Cl.[7] ..... B32B 31/14; B32B 31/16; B05D 3/12; B05D 1/38

[52] U.S. Cl. ..... 427/155; 427/246; 427/209; 427/354; 427/359; 427/369; 427/381; 427/412; 156/77; 156/78; 156/79

[58] Field of Search ..... 427/209, 177, 427/155, 179, 300, 246, 358, 353, 354, 369, 434.2, 381, 412, 359; 264/45.6, 45.8, 46.1, 46.3, 46.4; 156/77, 78, 79

[56] References Cited

U.S. PATENT DOCUMENTS

| | | | |
|---|---|---|---|
| 3,393,083 | 7/1968 | Go | 427/155 |
| 3,619,315 | 11/1971 | Carrack et al. | 156/77 |
| 3,632,842 | 1/1972 | Forrest | 264/46.3 |
| 3,696,180 | 10/1972 | Cunningham et al. | 264/49 |
| 3,845,182 | 10/1974 | Biskup et al. | 427/155 |
| 3,951,593 | 4/1976 | Wojdasiewicz et al. | 8/94.15 |
| 3,979,532 | 9/1976 | Muck et al. | 427/245 |
| 4,003,777 | 1/1977 | Eddy | 264/45.6 |
| 4,046,504 | 9/1977 | Fukushima | 8/17 |
| 4,157,424 | 6/1979 | Boutle | 264/45.8 |
| 4,165,556 | 8/1979 | Nishida et al. | 264/172.18 |
| 4,171,391 | 10/1979 | Parker | 427/246 |
| 4,206,257 | 6/1980 | Fukushima et al. | 428/91 |
| 4,271,217 | 6/1981 | Tanaka et al. | 427/155 |
| 4,304,812 | 12/1981 | Perkins | 427/155 |
| 4,318,949 | 3/1982 | Okamoto et al. | 428/91 |
| 4,349,597 | 9/1982 | Fine et al. | 427/209 |
| 4,431,687 | 2/1984 | Fottinger et al. | 427/246 |
| 4,487,642 | 12/1984 | Takashima et al. | 156/77 |
| 4,539,056 | 9/1985 | Takeshita et al. | 427/257 |
| 4,587,142 | 5/1986 | Huguchi et al. | 428/15 |
| 4,675,211 | 6/1987 | Thoma et al. | 427/208.8 |
| 5,151,240 | 9/1992 | Asano et al. | 427/246 |
| 5,393,600 | 2/1995 | Omura et al. | 427/246 |
| 5,753,351 | 5/1998 | Yoshida et al. | 428/196 |
| 5,922,445 | 7/1999 | Yoshida et al. | 428/245 |

FOREIGN PATENT DOCUMENTS

| | | | |
|---|---|---|---|
| 0012565 | 5/1978 | Japan | 427/155 |

*Primary Examiner*—Diana Dudash
*Attorney, Agent, or Firm*—Rosenberg, Klein & Lee

[57] ABSTRACT

A process for making PU air permeable nubuck sheets includes coating a separable release substrate material such an cloth, plastics, or paper with a polyurethane (PU) resin preparation before disposing the same in an impregnation tank to allow the PU resin to congeal into a sheet of minute pores attached to the release substrate material. The release substrate material together with the sheet is soaked in a wash tank to rinse off residual dimethyformamide (DMP) A beck surface of the release substrate material is coated with a water soluble resin (which may later dissolve in water and then be rinsed off) and the release substrate material is put into an oven to dry and then removed to a grinder for processing into a nubuck sheet with the feel and visual characteristics of real nubuck. The nubuck sheet is washed in a wash tank to rinse off the water soluble resin, dried, subjected to surface finishing, and than separated from the release substrate material to obtain a PU air permeable nubuck sheet.

5 Claims, 1 Drawing Sheet

PROCESS FOR MAKING PU AIR PERMEABLE NUBUCK SHEETS

CROSS-REFERENCE

This is a continuation-in-part application of U.S. patent application Ser. No. 08/898,153, filed Jul. 22, 1997, now abandoned.

BACKGROUND OF THE INVENTION

1. Field of the Invention

This invention relates to a process for making nubuck sheets.

2. Description of the Prior Art

Application of polyurethane (PU) nubuck is restricted to manufacture of industrial fabrics and non-woven fabrics and cannot be found in high-grade fabrics or materials. Therefore, high-grade materials cannot have the feel and visual characteristics of nubuck to enhance their sales and applications.

SUMMARY OF THE INVENTION

This invention relates to a process for making nubuck sheets.

It is a primary object of the present invention to provide a special polyurethane (PU) air permeable nubuck that may be adapted for use on genuine leather, split, ultra-fine fibers, high-grade and organic cloth materials, etc., to achieve a high-class leather material with the feel and visual effects of real nubuck, that may simulate the feel and visual characteristics of furs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
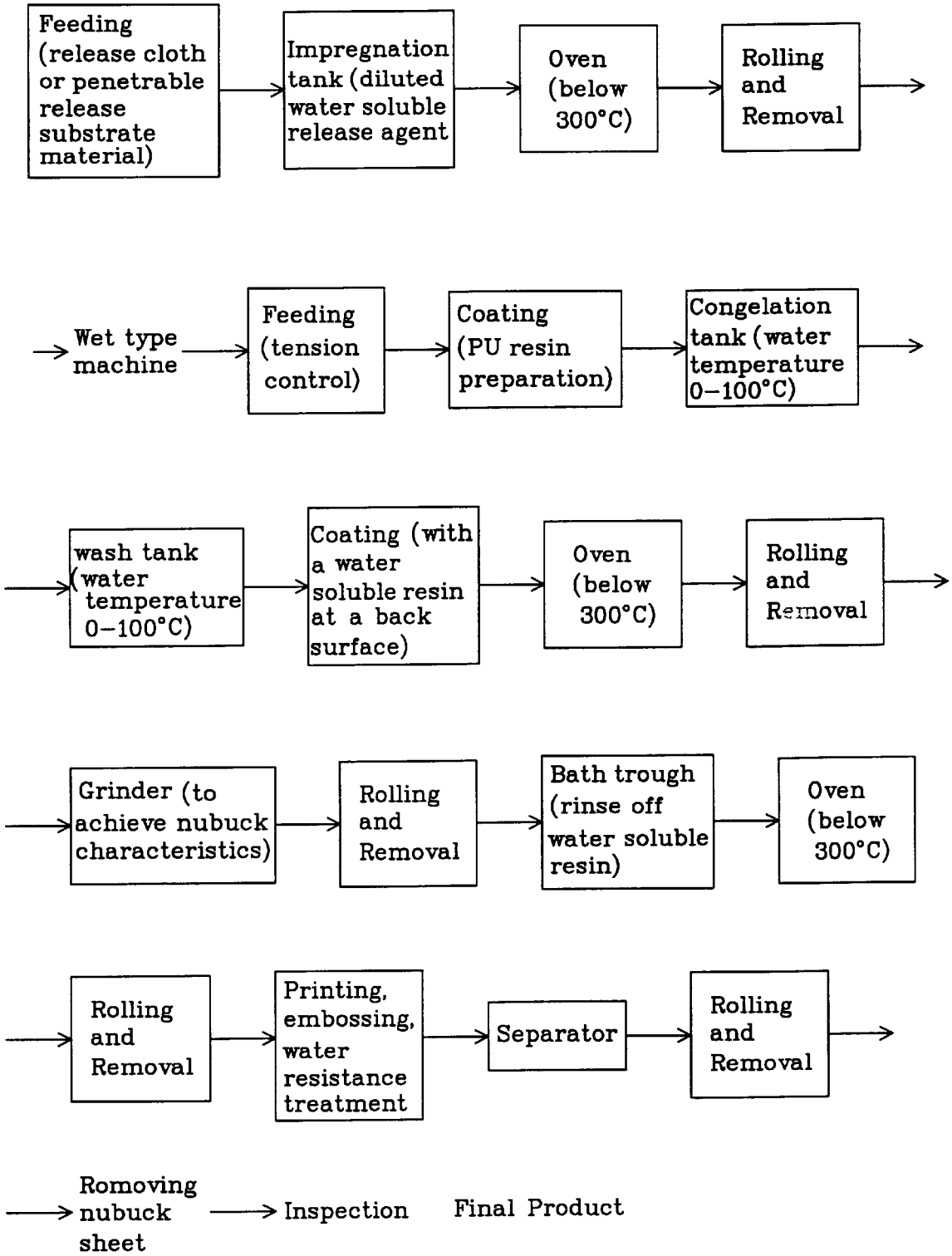
FIG. 1 is a schematic flow-chart of the present invention.

For the purpose of promoting an understanding of the principles of the invention, reference will now be made to the embodiment illustrated in the drawings. Specific language will be used to describe same. It will, nevertheless, be understood that no limitation of the scope of the invention in thereby intended, such alterations and further modifications in the illustrated device, and such further applications of the principles of the invention as illustrated herein being contemplated as would normally occur to one skilled in the art to which the invention relates, The process of making a PU, air permeable, nubuck is as shown in FIG. 1, in which:

1. An entire roll of separable substrate release material is placed on a feed table and sent to an impregnation tank. The impregnation tank contains diluted, water soluble release resin. Impregnating the release material in this type of resin may enhance separation effects. After impregnation, excessive resin is squeezed out using rollers so that the resin may distribute uniformly on the release material. After spreading and stretching, the release material is put into an oven set at a temperature below 300 degrees centigrade for drying, fixing, and then rolling.

2. The dried, fixed and rolled-up release material is then moved to a wet type machine. After the release material has been leveled out by feeding and tension controlling, it in coated with a PU resin preparation of a determined thickness. The PU resin is for forming nubuck, and the components of the polyurethane (PU) resin preparation are: 100 parts by weight PU resin; 30–150 parts by weight dimethylformamide (DMP); 0–10 parts by weight additive and 0–30 parts by weight colorants. The material is passed through a congelation tank containing DMF solution at a water temperature of 0–100 degrees centigrade so that the PU resin congeals into a foamed sheet with minute pores. The DMF solution is rinsed off by putting the foamed sheet in a water tank having a temperature of 0–100 degrees centigrade.

3. After rinsing, the synthetic release material in coated or spray coated with water soluble resin such as polyvinyl alcohol (PVA), acrylic, polyurethane (PU) . . . (which may penetrate the release material to enhance the cohesion of the PU sheet and the release material and which may, at the same time, be rinsed off). The material is dried in an oven at below 300 degrees centigrade and then removed.

4. The dried synthetic release material and overlaying PU sheet are together then sent to a grinder for coarse and fine processing of the PU sheet so that it may have the feel and visual characteristics of nubuck. It is then removed to a wash trough where the water soluble resin coated on the material in rinsed off using cold or hot water. The material in then placed in the oven for drying at below 300 degrees centigrade. At this point, the synthetic release material may be subject to special processing such as printing, embossing, water-resistance treatment, etc. After processing, the release material is separated from the nubuck sheet to obtain a PU nubuck sheet of a thickness between 0.1 mm–0.66 mm having good air permeability and the feel and visual characteristics of nubuck.

The separable substrate material used in the process has wettability. Fibrous woven materials such as polyester, nylon, polypropylene and other substrate materials having equivalent functions may be used an well. Besides, the substrate material may undergo chemical treatment to enhance its separability.

Furthermore, step 3 as described above is a characterizing feature of the process of the invention. If the material in not coated or spray coated with water voluble resin, the PU sheet will easily separate from the release material during grinding, making processing very difficult. The present invention employs the water soluble resin to penetrate the release material so as to enhance the cohesion between the PU sheet and the release material and to thereby facilitate processing, decrease work hours, and reduce waste of materials.

In summary, the special PU air permeable nubuck sheet of the invention may be attached to all kinds of genuine leather, split, ultra-fine fibers, high-class and organic cloth materials or other materials to form a high-class material having the feel and visual characteristics of real nubuck sheets.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A process for making a polyurethane (PU) air permeable nubuck sheet, comprising the steps of:

(a) providing a sheet of release material;

(b) impregnating said sheet of release material with a diluted water soluble release agent;

(c) drying and rolling said impregnated release material to produce a release substrate material;

(d) coating a top surface of said release substrate material with a PU resin liquid composition;

(e) immersing said coated release substrate material in a dimethylformamide (DMF) solution to congeal said PU resin liquid composition to form a PU foamed layer on said top surface of said release substrate material, said PU foamed layer having minute pores formed therein;

(f) rinsing residual DMF solution from said release substrate material and maid PU foamed layer formed thereon;

(g) coating a back surface of said release substrate material with a water soluble resin, said water soluble resin permeating said release substrate material;

(h) drying said water soluble resin, and then rolling said release substrate material and said PU foamed layer to provide uniform distribution there of;

(i) grinding said material of step (h) to form a nubuck layer from said PU foamed layer;

(j) washing said release substrate material and nubuck layer thereon with water to remove maid water soluble resin therefrom, and then drying said release substrate material and said nubuck layer;

(k) treating said nubuck layer, wherein maid treating step is selected from the group consisting of the steps of embossing, printing and water-proofing; and (l) separating said nubuck layer from said release substrate material.

2. The process as claimed in claim 1, wherein the nubuck sheet is permeable to air and has a thickness of 0.1 mm–0.66 mm.

3. The process as claimed in claim 1, wherein said release material is a liquid permeable material selected from the group consisting of polyester, nylon, and polypropylene.

4. The process as claimed in claim 1, wherein said water soluble resin coated on said back surface of said release substrate Material to enhance cohesion is selected from the group consisting of polyvinyl alcohol, acrylic and polyurethane.

5. The process an claimed in claim 1, wherein said PU resin liquid composition includes approximately 100 parts by weight PU resin, approximately 30–150 parts by weight DMF, approximately 0–10 parts by weight additive, and approximately 0–30 parts by weight colorant.

* * * * *